US009117420B2

(12) United States Patent
Fujisawa

(10) Patent No.: US 9,117,420 B2
(45) Date of Patent: Aug. 25, 2015

(54) INFORMATION DISPLAY DEVICE AND DISPLAY DRIVING METHOD

(75) Inventor: Hidetaka Fujisawa, Saitama (JP)

(73) Assignee: Optoelectronics Co., Ltd. (JP)

( * ) Notice: Subject to any disclaimer, the term of this patent is extended or adjusted under 35 U.S.C. 154(b) by 130 days.

(21) Appl. No.: 13/990,985

(22) PCT Filed: Dec. 1, 2011

(86) PCT No.: PCT/JP2011/077807

§ 371 (c)(1),
(2), (4) Date: Aug. 12, 2013

(87) PCT Pub. No.: WO2012/074056

PCT Pub. Date: Jun. 7, 2012

(65) Prior Publication Data

US 2013/0321385 A1 Dec. 5, 2013

(30) Foreign Application Priority Data

Dec. 1, 2010 (JP) ..... 2010-268576

(51) Int. Cl.
*G09G 3/36* (2006.01)
*G09G 3/32* (2006.01)
*G09G 3/20* (2006.01)

(52) U.S. Cl.
CPC ..... *G09G 3/3696* (2013.01); *G09G 3/20* (2013.01); *G09G 3/3216* (2013.01); (Continued)

(58) Field of Classification Search
CPC ..... G09G 2320/041; G09G 2330/026; G09G 2330/027; G09G 2330/028; G09G 2380/04; G09G 2330/02; G09G 3/20; G09G 3/36–3/3622; G09G 3/3696; G11C 5/145; H01L 27/0222; G05F 3/205
USPC ..... 327/530–550, 560–573, 588–590
See application file for complete search history.

(56) References Cited

U.S. PATENT DOCUMENTS 4,217,543 A * 8/1980 Strong ..... 324/710
5,374,941 A * 12/1994 Yuki et al. ..... 345/97

(Continued)

FOREIGN PATENT DOCUMENTS

JP 10-319368 A 12/1998
JP 2002-062851 A 2/2002

(Continued)

OTHER PUBLICATIONS

"International Application No. PCT/JP2011/077807", "Translation of Written Opinion of the International Searching Report", Feb. 28, 2012, Publisher: PCT—ISA / JP, Published in: JP.

*Primary Examiner* — Patrick F Marinelli
(74) *Attorney, Agent, or Firm* — Kaplan Breyer Schwarz & Ottesen, LLP

(57) ABSTRACT

An information displaying device is provided with a display portion that displays an image based on display information and a predetermined driving voltage, a CPU that sets a boost target value of the driving voltage of the display portion, a voltage divider resistance circuit that divides a power supply voltage to generate output candidates of the driving voltage having plural output values, a selector that selects the output values, successively, based on tap selection signals from a lower rank of the output candidates of the driving voltages in the voltage divider resistance circuit to a higher rank thereof and boosts the driving voltage and a slow starter that compares an output value of the driving voltage boosted by the selector with the boost target value set by the CPU, determines whether or not the output value of the driving voltage reaches the boost target value, and drives the display portion at the driving voltage reaching the boost target value based on a determination result thereof. This enables the display portion to start independent of any booster circuit of hardware configuration and enables a circuit scale as a whole to be made smaller.

12 Claims, 12 Drawing Sheets

(52) U.S. Cl.
CPC ..... *G09G 3/3622* (2013.01); *G09G 2310/0243* (2013.01); *G09G 2320/041* (2013.01); *G09G 2320/06* (2013.01); *G09G 2330/02* (2013.01); *G09G 2330/026* (2013.01); *G09G 2330/028* (2013.01); *G09G 2380/04* (2013.01)

(56) References Cited

U.S. PATENT DOCUMENTS

| | | | | |
|---|---|---|---|---|
| 6,124,852 | A * | 9/2000 | Yamagishi et al. | 345/209 |
| 6,177,919 | B1 * | 1/2001 | Numao | 345/94 |
| 6,256,006 | B1 * | 7/2001 | Yamamoto et al. | 345/101 |
| 6,310,595 | B1 * | 10/2001 | Shigeta | 345/97 |
| 6,326,959 | B1 * | 12/2001 | Tanaka | 345/211 |
| 6,930,667 | B1 * | 8/2005 | Iijima et al. | 345/101 |
| 7,075,464 | B2 * | 7/2006 | Hehn | 341/118 |
| 7,839,203 | B1 * | 11/2010 | MacLean et al. | 327/540 |
| 8,200,178 | B2 * | 6/2012 | Moser et al. | 455/226.1 |
| 2003/0052869 | A1 * | 3/2003 | Fujii et al. | 345/204 |
| 2006/0013044 | A1 * | 1/2006 | Cheung | 365/185.18 |
| 2007/0024553 | A1 * | 2/2007 | Araki et al. | 345/87 |

FOREIGN PATENT DOCUMENTS

| | | | |
|---|---|---|---|
| JP | 2004-4630 | A | 1/2004 |
| JP | 2007-236154 | A | 9/2007 |
| JP | 2008-107732 | A | 5/2008 |
| JP | 2008-109747 | A | 5/2008 |
| JP | 2008-131763 | A | 6/2008 |
| JP | 2010-192590 | A | 9/2010 |

* cited by examiner

INFORMATION DISPLAY DEVICE AND DISPLAY DRIVING METHOD

TECHNICAL FIELD

The present invention relates to an information displaying device and a display driving method which are applicable to an electronic shelf label (price tag), an electronic personal authentication card, an electronic ticket and an information processing system applying the same, on which an image about a name of article, its price and the like is displayed using a light, thin and small sized display panel.

BACKGROUND

A small sized display panel of liquid crystal type or inorganic or organic electro-luminescence (EL) type has been produced on a large scale at a low price in recent years. The small sized display panel of this type has been used for the electronic shelf label, the electronic personal authentication card, the electronic ticket and the like. The electronic shelf label has been placed in a supermarket or a retail store to display a price of article on the display panel. This enables the price thereof to be changed promptly, when the sum of money thereof have changed many times a day because of special limited offers or special sales, by any wireless information transfer or any information transfer through wire.

The electronic personal authentication card has been used for permission card of entrance or exit of a visitor when he or she temporarily visits an office building or the like of an enterprise. This enables his or her section, guidance in a company, public relations (PR) of product of the company or the like to be displayed at need. The electronic ticket has been used for a ticket of admission of a concert or an amusement park. This enables any necessary information for a user such as a program on that day, a schedule or the like to be displayed promptly. If this is able to be collected, this may be reused on another event. Of course, such cards are driven using a battery. The following will describe a configuration of such an electronic card for these uses.

FIG. 12 is a block diagram of an information displaying device 10 according to the conventional example showing the configuration example thereof. The information displaying device 10 shown in FIG. 12 is applicable to the above-mentioned electronic cards and is configured to have a driver IC 2, a booster circuit 3, a power supply 4, CPU 5, and a display portion 12. The display portion 12 has a liquid crystal display board 101.

The power supply 4 is connected with the booster circuit 3 and the CPU 5 and the booster circuit 3 is connected with the driver IC 2. The driver IC 2 is connected with the liquid crystal display board 101 through a common electrode wiring (hereinafter, referred to as "COM wiring 13") and a pixel electrode wiring (hereinafter, referred to as "SEG wiring 14"). The power supply 4 is a driving force for supplying electric power to the booster circuit 3 and the CPU 5.

The booster circuit 3 is a voltage-generating means for generating plural driving voltages and supplying them to the driver IC 2. The voltage-generating means fixes COM reference voltage, SEG-High voltage and SEG-Low voltage which are generated by a voltage divider that is composed of a transistor, resistance, an external electrolytic capacitor and the like and supplies them to the driver IC 2.

The CPU 5 controls input/output of the booster circuit 3 and the driver IC 2. The CPU 5 outputs a power notice signal S5 of previously set logic to the booster circuit 3. The booster circuit 3 becomes off state when the power notice signal of active state (high level) is received and becomes on state when the power notice signal of inactive state (low level) is received.

After the COM reference voltage, SEG-High voltage and SEG-Low voltage to the liquid crystal display board 101 have become off state by the CPU 5, the above-mentioned booster circuit 3 operates to discharge electric charges charged on the COM electrode and the SEG electrode, respectively, of each pixel in the liquid crystal display board 101. The driver IC 2 has an X driver 26 for COM electrode (shown as COM electrode DIV (X) in the drawing) and a Y driver 27 for SEG electrode (shown as SEG electrode DIV (Y) in the drawing).

The display portion 12 displays an image based on the X driver 26 and the Y driver 27. In the display portion 12, the COM electrode is arranged along an X direction (row direction) and the SEG electrode is arranged a Y direction (column direction), which are not shown. In the display portion 12, the COM electrode and the SEG electrode are arranged so as to be intersected.

Here, a flow of signal from the driver IC 2 to the display portion 12 will be described. The driver IC 2 shown in FIG. 12 operates to drive and display the display portion 12 by applying pixel voltages based on the display information such the an image, "ABC" is displayed on the SEG electrodes along the Y direction through the Y driver 27 and the SEG wiring 14 and by applying a scanning signal on the COM electrodes along the X direction through the X driver 26 and the COM wiring 13.

In this moment, the X driver 26 applies a bias voltage (COM voltage) constituting the scanning signal on the COM electrodes along the X direction through the COM wiring 13 and applies a bias voltage (SEG voltage) constituting the pixel signal on the SEG electrodes along the Y direction through the SEG wiring 14. When the bias voltage is applied to the COM electrode and the SEG electrode at the same time, a dot of the intersection thereof turns on a light. This enables the image, "ABC" to be displayed on the display portion 12.

Regarding such information displaying device, patent document 1 discloses a liquid crystal display driving circuit. In the liquid crystal display driving circuit, a power supply circuit, an output circuit, a booster circuit, a resistance circuit and two capacitors are provided. The resistance circuit is configured so that two resistance elements are connected in series.

An end of the power supply circuit and an end of the resistance circuit are connected with a power supply at a higher potential side. The other end of the power supply circuit is connected with an end of the booster circuit and an output of the booster circuit is connected with the output circuit. The other output of the booster circuit is connected with the power supply at a lower potential side through second capacitor. An output terminal of the output circuit is connected with a connection point between the resistance elements in the resistance circuit through a first capacitor.

The power supply circuit receives voltage supplied from an outer power supply having the power supplies with the higher potential side and the lower potential side. The booster circuit receives an output from the power supply circuit and boosts it. The output circuit receives one output of the booster circuit. The second capacitor allows the other output of the booster circuit to be connected with the lower potential side. A part of the output from the output circuit is connected with the lower potential side through the first capacitor and the resistance element. On assumption thereof, when applying an output voltage of the output circuit on the liquid crystal display, the resistance circuit switches on or off based on polarities of the output of the booster circuit. Thus configured liquid crystal display driving circuit enables to be manufactured the same configuration model (of mobile phone) without any reference to positive or negative of the voltage output of the booster circuit.

Regarding such information-displaying device, patent document 2 discloses a display power supply device and an image displaying apparatus. According to the image displaying apparatus, the display power supply device, a display controller and a display portion are provided. The display power supply device has voltage-generating means, switching means and resistance elements. To the display controller, the voltage-generating means is connected.

To an output terminal of the voltage-generating means, the display portion and an end of the switching means are connected through an output wiring. The other end of the switching means is connected to an end of the resistance element. The other end of the resistance element is connected to a lower potential side. The voltage-generating means outputs plural predetermined output voltages to the display portion based on a power supply OFF notice signal and an input voltage. The display controller outputs the power supply OFF notice signal to the voltage-generating means and the switching means. The display controller outputs a display signal to the display portion.

The display portion displays an image based on the display signal and the output voltage. On assumption thereof, the display controller controls the voltage-generating means to output the plural predetermined output voltages or stop them and controls the switching means to switch from off to on when controlling the voltage-generating means to stop them. Thus configured image display apparatus enables any residual image and latch-up after the power supply is switched off to be avoided and it enables electrical power consumption during display driving to be decreased.

PRIOR ART DOCUMENTS

Patent Documents

Patent Document 1: Japanese Patent Application Publication No. 2002-062851 (see page 3 and FIG. 1)

Patent Document 2: Japanese Patent Application Publication No. 2004-004630 (see page 9 and FIG. 3)

SUMMARY

In the conventional information displaying device 10, there are following problems:

1. Volume occupying the booster circuit 3 in a printing circuit board does not particularly become an issue in a relatively large sized display device such as a desk-top liquid crystal television, a game player and the like. In a small sized information displaying device, however, such as the mobile phone disclosed in the patent document 1 or the above-mentioned electronic shelf label and the like, the printed circuit board itself is small and narrow so that the volume occupying the booster circuit 3 in the printing circuit board becomes larger. This causes an issue such that downsizing and weight reduction of the information displaying device to be prevented.

2. When a method is employed such that the display portion is driven depending on the voltage generating means (booster circuit) of hardware configuration in the image displaying device shown in the patent document 2 or the information displaying device shown in FIG. 12, an issue occurs such that a circuit scale becomes larger as a whole.

In order to solve the above-mentioned problem, an information displaying device is further characterized in that the device is provided with a display portion that displays an image based on display information and a predetermined driving voltage, an information-setting portion that sets a boost target value of the driving voltage of the display portion, a voltage output portion that divides a power supply voltage to generate output candidates of the driving voltage having plural output values, a voltage selection portion that selects the output values, successively, based on a predetermined selection control signal from a lower rank of the output candidates of the driving voltage in the voltage output portion to a higher rank thereof and boosts the driving voltage, and a boost control portion that compares the output value of the driving voltage boosted by the voltage selection portion with the boost target value set by the information-setting portion, determines whether or not the output value of the driving voltage reaches the boost target value, and drives the display portion at the driving voltage reaching the boost target value based on a determination result thereof.

In the information displaying device, the display portion displays an image based on display information and a predetermined driving voltage. The information-setting portion sets a boost target value of the driving voltage of the display portion. The voltage output portion divides a power supply voltage to generate output candidates of the driving voltage having plural output values. The voltage selection portion selects the output values, successively, based on a predetermined selection control signal from a lower rank of the output candidates of the driving voltage in the voltage output portion to a higher rank thereof and boots the driving voltage. On an assumption thereof, the boost control portion compares the output value of the driving voltage boosted by the voltage selection portion with the boost target value set by the information-setting portion, determines whether or not the output value of the driving voltage reaches the boost target value, and drives the display portion at the driving voltage reaching the boost target value based on a determination result thereof.

Such display driving enables the driving voltage for driving the display portion to be booted by software. This allows the display portion to start independent of any booster circuit of hardware configuration like the conventional system.

The information displaying device is further characterized in that the voltage output portion, the driving voltage of which is boosted by the voltage selection portion, comprises a voltage divider resistance circuit containing a series circuit in which plural resistance elements are connected in series, an end of the series circuit being connected with a higher potential side, the other end of the series circuit being connected with a lower potential side and taps being tapped from a connection point between the resistance elements.

The information displaying device is further characterized in that the voltage selection portion comprises a selector which is connected with plural taps of the voltage output portion and selects the tap based on a predetermined selection control signal.

The information displaying device is further characterized in that the voltage output portion comprises an operational amplifier which generates the driving voltage based on a predetermined gain control signal.

The information displaying device is further characterized in that the device is provided with a temperature detecting portion that detects ambient temperature including the display portion and outputs temperature information to the information-setting portion, and a storage portion that stores the boost target value of the driving voltage corresponding to the temperature information obtained from the temperature detecting portion.

The information displaying device 5 is further characterized in that the display portion is provided with a liquid crystal layer in which liquid crystal is held between photo-alignment films, a substrate of pixel electrode side that includes a pixel electrode for every pixel and contains a polarizing film, a glass plate and a transparent conductive film for the pixel electrode, and from which the pixel wiring is led, and a substrate of counter electrode side that includes a counter electrode at a position which faces the pixel electrode and contains a polarizing film, a glass plate and a transparent conductive film for the counter electrode, and from which the counter wiring is led, wherein the display portion includes a liquid crystal display substrate in which the liquid crystal layer is held by the substrate of pixel electrode side and the substrate of counter electrode side.

The information displaying device is further characterized in that the display portion is provided with an organic EL thin film containing at least a positive electrode having a transparent conductive film for a scanning line, a hole transporting layer which transports a hole, a light emitting layer which emits light, an electron transporting layer which transports an electron, and a negative electrode having a transparent conductive film for a data line, a cover glass substrate and a seal glass substrate, wherein the display portion includes an organic EL display substrate in which the organic EL layer is held by the cover glass plate and the seal glass.

A display driving method is a display driving method of controlling the driving of a display portion that displays an image based on display information and a predetermined driving voltage, characterized in that an information displaying device carries out a step of, on the one side, setting a boost target value of a driving voltage of the display portion, a step of, on the other side, dividing a power supply voltage to generate output candidates of the driving voltage having plural output values, a step of selecting the output values, successively, based on a predetermined selection control signal from a lower rank of the output candidates of the driving voltage to a higher rank thereof and boosting the driving voltage, a step of comparing the output value of the boosted dnving voltage with the set boost target value and determining whether or not the output value of the driving voltage reaches the boost target value, and a step of driving the display portion at the driving voltage reaching the boost target value based on a determination result thereof.

The display driving method is further characterized in that the information displaying device carries out a step of detecting ambient temperature including the display portion and obtaining temperature information, and a step of reading out the boost target value of the driving voltage corresponding to the obtained temperature information to set it.

An information displaying device is characterized in that the device is provided with a display portion that displays an image based on display information and a predetermined driving voltage, a voltage generating portion that generates driving voltage of the display portion based on a control target value thereof, a temperature delecting portion that detects ambient temperature including the display portion and outputs temperature information, an information-setting portion that sets the control target value of the driving voltage of the display portion in the voltage generating portion, the control target value corresponding to the temperature information output from the temperature detecting portion, and a display controlling portion that drives the display portion based on the driving voltage of the control target value set in the voltage generating portion by the information-setting portion.

According to the information displaying device claimed in claim 10. the display portion displays an image based on display information and a predetermined driving voltage. The voltage generating portion generates driving voltage of the display portion based on a control target value thereof. The temperature detecting portion detects ambient temperature including the display portion and outputs temperature information. The information-setting portion sets the control target value of the dnving voltage of the display portion in the voltage generating portion, the control target value corresponding to the temperature information output from the temperature detecting portion. On an assumption thereof, the display controlling portion drives the display portion based on the driving voltage of the control target value set in the voltage generating portion by the information-setting portion. Such display driving enables the driving voltage for driving the display portion to be booted by software. This allows the display portion to start independent of any booster circuit of hardware configuration like the conventional system.

The information displaying device is further characterized in that the device is provided with a storage portion that stores the control target value of the driving voltage of the display portion, the control target value corresponding to the temperature information obtained from the temperature detecting portion, wherein the storage portion stores a look up table in which the control target value of the dnving voltage of the display portion is set as a parameter, a writing speed of the driving voltage is plotted on a vertical axis, and the ambient temperature including the display portion is plotted on a transverse axis and by which a writing speed of the driving voltage corresponding to the temperature information is previously looked up.

The information displaying device is further characterized in that the voltage generating portion includes a voltage output portion that divides a power supply voltage to generate output candidates of the driving voltage having plural output values, and a voltage selection portion that selects the output candidates of the driving voltage generated by the voltage output portion, successively, having plural output values, based on a predetermined selection control signal.

A display driving method is a display driving method of controlling the driving of a display portion that displays an image based on display information and a predetermined driving voltage, characterized in that an information displaying device carries out a step of, on the one side, generating the driving voltage of the display portion based on a control target value thereof, a step of, on the other side, detecting ambient temperature including the display portion and obtaining temperature information, a step of setting the control target value of the driving voltage of the display portion, the control target value corresponding to the obtained temperature information, and a step of driving the display portion based on the driving voltage of the set control target value.

According to the first information displaying device and display driving method, the boost control portion for driving the display portion at a predetermined driving voltage is provided and this boost control portion compares the output value of the driving voltage boosted by the voltage selection portion with the boost target value set by the information-setting portion, determines whether or not the output value of the driving voltage reaches the boost target value, and drives the display portion at the driving voltage reaching the boost target value based on a determination result thereof.

Such a configuration enables the driving voltage for driving the display portion to be booted by software. This allows the display portion to start independent of any booster circuit of hardware configuration like the conventional system. Further, the voltage output portion can be formed as semiconductor integrated circuit using the voltage divider resistance elements by a field effect transistor, the operational amplifier by a differential transistor or the like. Additionally, the voltage selection portion can be also formed as semiconductor integrated circuit using the selector by the same transistors. Accordingly, a circuit scale thereof as a whole can be made smaller than that of the conventional system, which considerably contributes to downsizing and thinning of the information displaying device that is applicable to an electronic shelf label, an electronic personal authentication card, an electronic ticket and the like.

According to the second information displaying device and display driving method, the display controlling portion drives the display portion based on the driving voltage of the control target value, which corresponds to the temperature information, set in the voltage generating portion by the information-setting portion.

Such a configuration enables the driving voltage for driving the display portion to be booted by software according to the temperature information. This allows the display portion to start independent of any booster circuit of hardware configuration like the conventional system.

DETAILED DESCRIPTION

This invention solves the above-mentioned problems and has an object of presenting an information displaying device and a display driving method, which enables the display portion to start independent of any booster circuit of hardware configuration like the conventional system and enables a circuit scale as a whole to be made smaller than that of the conventional system.

Figure 1:
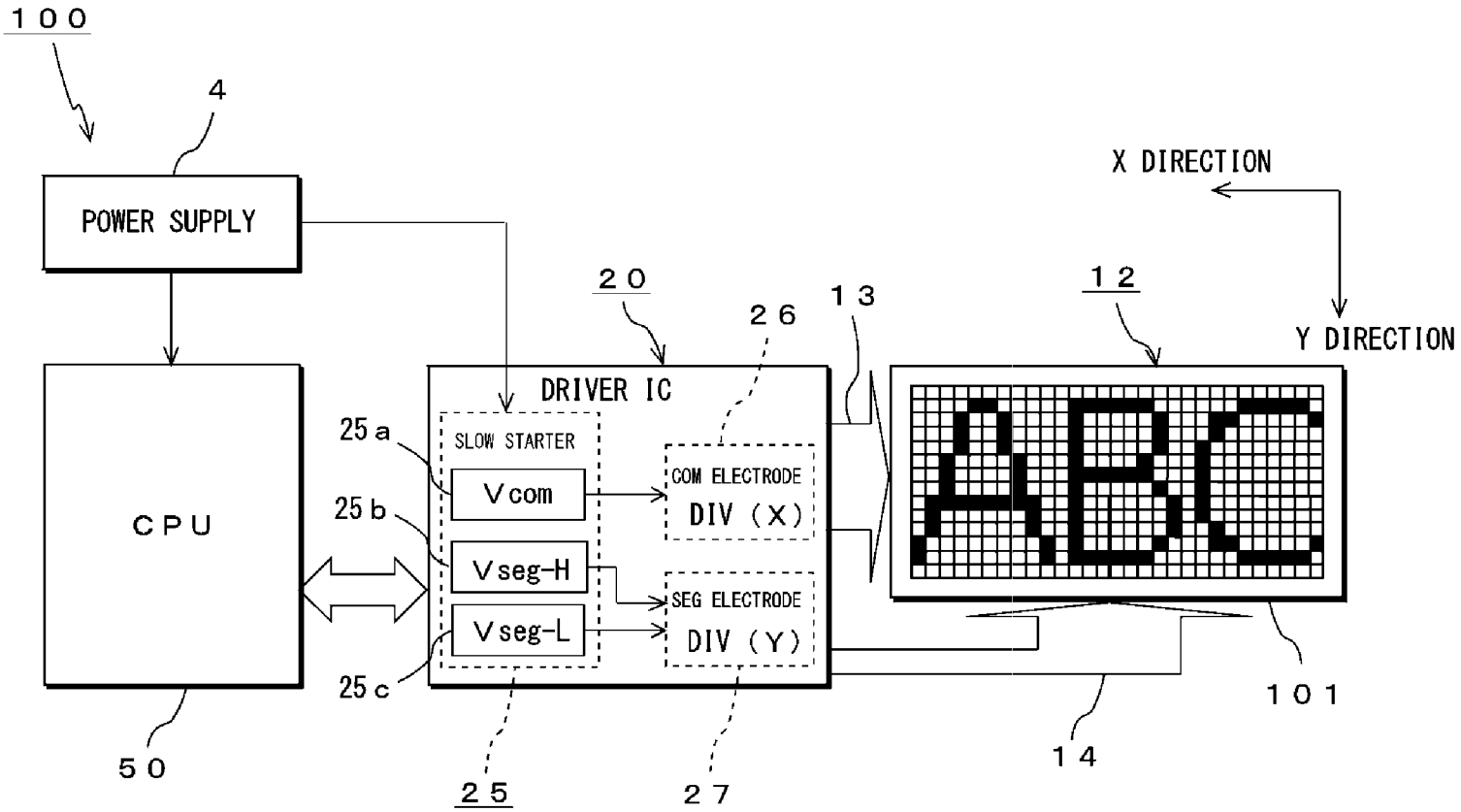
FIG. 1 is a block diagram of an information displaying device 100 as an embodiment according to the invention showing a configuration example thereof.

The following will describe the information displaying device and the display driving method according to this invention with reference to drawings. The information displaying device 100 shown in FIG. 1 is applicable to a small sized display panel such as the electronic shelf label and is configured to have a power supply 4, a display portion 12, a driver IC 20 for display driving and a central processing unit (hereinafter, referred to as "CPU 50"). In this embodiment, there is no booster circuit 3 like the conventional example. The driving voltage for displaying is set so as to be boosted under a software control in the driver IC 20.

The power supply 4 is connected with the driver IC 20 and the CPU 50 and supplies a power supply voltage thereto. The CPU 50 constitutes an information-setting portion and is connected with the driver IC 20. The CPU 50 operates to set a control target value of the driving voltage of the display portion 12 when raising the voltage and lowering the voltage. To the driver IC 20, the display portion 12 is connected. The display portion 12 has a liquid crystal display substrate 101 and is connected with the driver IC 20 through a common electrode wiring (hereinafter, referred to as "COM wiring 13") of X direction and a pixel electrode wiring (hereinafter, referred to as "SEG wiring 14") of Y direction.

The display portion 12 has a liquid crystal display substrate 101 and displays an image based on display information and predetermined driving voltages, for example, a common voltage (hereinafter, referred to as "COM voltage") that is commonly applied to X direction lines, a pixel voltage of higher potential side (hereinafter, referred to as "SEG-H voltage") and a pixel voltage of lower potential side (hereinafter, referred to as "SEG-L voltage").

The driver IC 20 is configured to have a slow starter 25, an X driver 26 for COM electrode (shown as COM electrode DIV(x) in the drawing) and a Y driver 27 for SEG electrode (shown as SEG electrode DIV(Y) in the drawing). The slow starter is configured to have a slow starter 25*a* for COM voltage, a slow starter 25*b* for SEG-H voltage (Vseg-H) and a slow starter 25*c* for SEG-L voltage (Vseg-L).

According to the display portion 12, in the liquid crystal display substrate 101, COM electrodes, not shown, are disposed along the X direction and SEG electrodes are disposed along the Y direction. A pixel is composed at an intersection of each of the COM electrodes along the X direction and each of the SEG electrodes along the Y direction. The driving of the display portion 12 is carried out by the driver IC 20 including the X driver 26 and the Y driver 27. The X driver 26 applies bias voltage (COM voltage) on the COM electrodes along the X direction through the COM wiring 13. The Y driver 27 applies bias voltage (SEG voltage) on the SEG electrodes along the Y direction through the SEG wiring 14. When the bias voltage is applied on the COM electrode and the SEG electrode at the same time, a dot of the intersection constituting one pixel is turned on a light.

Numbers of the X drivers 26 and the Y drivers 27 used in the liquid crystal display substrate 101 are set based on the screen size of the X direction and the Y direction in the liquid crystal display substrate 101. It is to be noted that when a lighting condition is updated in each dot constituting one pixel in the display portion 12, only applied condition of the bias voltage in the corresponding SEG and COM electrodes may be updated.

Figure 2:
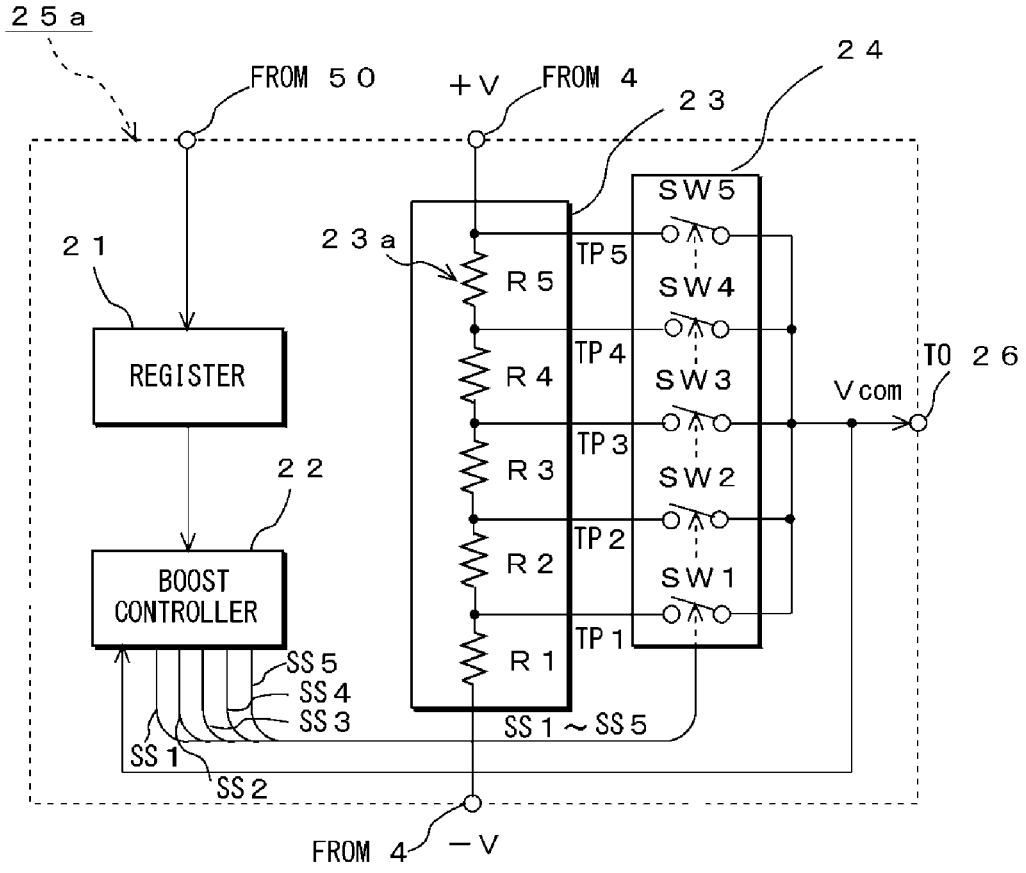
FIG. 2 is a block diagram of a slow starter 25*a* for Vcom showing an internal configuration thereof.

Here, the following will describe an internal configuration example of the slow starter 25*a* for Vcom with reference to FIG. 2. It is to be noted that regarding the slow starter 25*b* for Vseg-H and the slow starter 25*c* for Vseg-L, they have internal configurations which are the same internal configuration as that of the slow starter 25*a* for Vcom, a description of which will be omitted.

The slow starter 25*a* shown in FIG. 2 is configured to have a register 21, a boost controller 22, a voltage divider resistance circuit 23 and a selector 24 in order to boost the voltage of Vcom under the software control in the driver IC 20. According to the slow starter 25*a*, it is possible to dividing the power supply voltage and select plural voltages of Vcom (driving voltages).

The register 21 is connected with the CPU 50 shown in FIG. 1 and the control target values of voltage of Vcom in the display portion 12 when boosting or dropping the voltage are set in the register 21 by the CPU 50. As the register 21, a register in the driver IC 20 is used. To the register 21, the boost controller 22 is connected. The boost controller 22 constitutes a boost control portion and is stored as program in the driver IC 20. The boost controller 22 outputs tap selection signals SS1 through SS5 as an example of the selection control signal to the selector 24 based on the control target value set by the CPU 50. The tap selection signals SS1 through SS5 are signals for the selector 24 to select the driving voltages output from the taps TP1 through TP5 of the voltage divider resistance circuit 23.

Further, the boost controller 22 compares the output value of the voltage of Vcom selected by the selector 24 with the control target value set by the CPU 50, determines whether or not the output value of the voltage of Vcom reaches the control target value, and drives the display portion 12 at the voltage of Vcom reaching the boost target value based on a determination result thereof.

In the slow starter 25*a*, the voltage divider resistance circuit 23 constituting a voltage output portion is provided. The voltage divider resistance circuit 23 is connected with the power supply 2 shown in FIG. 1 and divides the power supply voltage to generate output candidates of the driving voltage having plural output values. The voltage divider resistance circuit 23 has a series circuit 23*a* in which plural resistance elements, for example, five resistance elements R1 through R5 are connected in series. It is configured so that an end of the series circuit 23*a* is connected with a higher potential side (+V), the other end of the series circuit 23*a* is connected with a lower potential side (−V) and taps are tapped from respective connection points each between the resistance elements R1 through R5.

The tap Tp1 is a connection point between the resistance elements R1 and R2. The tap Tp2 is a connection point between the resistance elements R2 and R3. The tap Tp3 is a connection point between the resistance elements R3 and R4. The tap Tp4 is a connection point between the resistance elements R4 and R5. The tap Tp5 is a connection point between the resistance element R5 and the higher potential side (+V). The above-mentioned low potential side (−V) may be a ground GND. Such a configuration of the voltage divider resistance circuit 23 enables the voltages of Vcom (output candidates of driving voltage) having five output values to be led from the taps TP1 through TP5 of the voltage divider resistance circuit 23.

To the boost controller 22, the selector 24 constituting a voltage selection portion is connected. The selector 24 is configured so as to be connected to the five taps TP1 through TP5 of the voltage divider resistance circuit 23 and to select any one of the taps TP1 through TP5 based on a predetermined selection control signal. The voltage divider resistance circuit 23 and the selector 24 constitute a voltage generating portion and generate the driving voltages of the display portion 12 based on the control target value.

The selector 24 is configured to have five switch circuits SW1 through SW5. The switch circuits SW1 through SW5 are composed of, for example, field effect transistors. They perform On/Off controls of the gates of the corresponding transistors based on the tap selection signals SS1 through SS5 (selection control signals). Such a configuration of the selector 24 enables the voltages of Vcom having five output values to be selected from the five taps TP1 through TP5 of the voltage divider resistance circuit 23.

Thus, it is possible to select the output values, successively, based on the tap selection signals SS1 through SS5 output from the boost controller 22, from a lower rank of the output candidates of the driving voltages in the voltage divider resistance circuit 23 to a higher rank thereof and to supply the voltage of Vcom boosting the driving voltage to the display portion 12. Of course, when dropping the driving voltage, it may select the output values, successively, based on the tap selection signals SS1 through SS5 from a higher rank of the output candidates of the driving voltages in the voltage divider resistance circuit 23 to a lower rank thereof.

Additionally, although, regarding the voltage output portion, a case of the voltage divider resistance circuit 23 has been illustrated, it is not limited thereto: An operational amplifier may be used as the voltage output portion. The operational amplifier operates to generate the driving voltages based on a predetermined gain control signal. The gain control signal is a signal for regulating gains (amplification) of the operational amplifier. Such a configuration of the voltage output portion enables the output candidates of the driving voltage having plural output values to be output from the operational amplifier. The operational amplifier is composed of a differential transistor circuit including a semiconductor element such as a bipolar transistor, a field effect transistor and the like.

Figure 3:
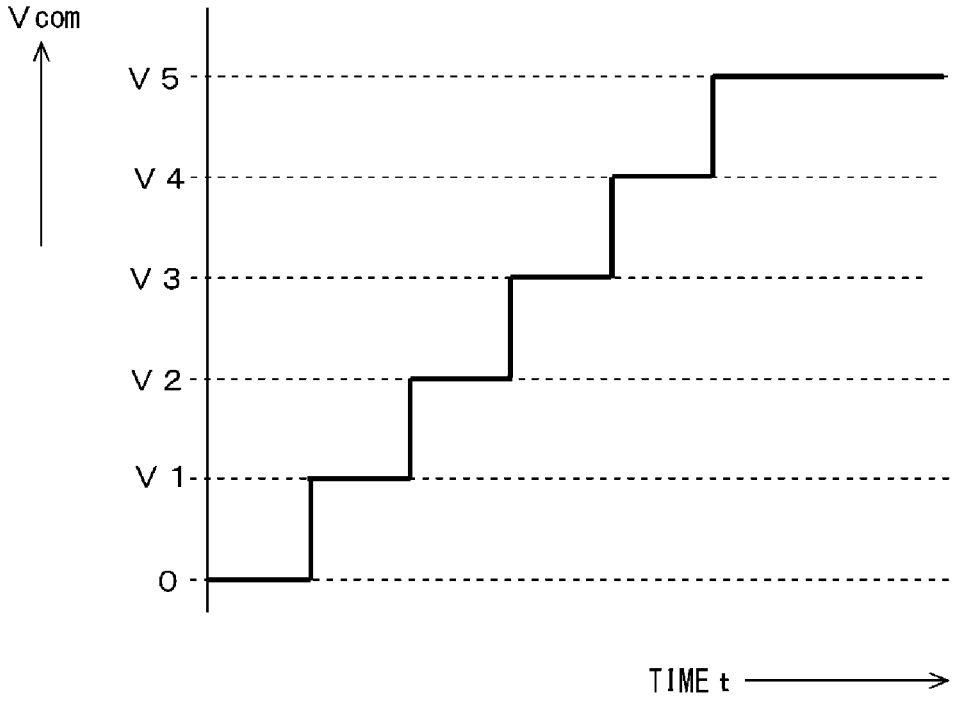
FIG. 3 is a wave form chart showing an output example of voltage of Vcom by the slow starter 25*a*.

Here, the following will describe an output example of the voltage of Vcom by the slow starter 25*a*. In FIG. 3, a vertical axis indicates the voltage of Vcom (driving voltage) which is applied on the COM electrodes of the display portion 12. The driving voltage V1 is an output voltage from the tap TP1 of the voltage divider resistance circuit 23.

The driving voltage V1 is output from the selector 24 as the voltage of Vcom by outputting the tap selection signal SS1 of, for example, high level to the switch circuit SW1 and switching the switch circuit SW1 on. It is to be noted that a period of time when the tap selection signal SS1 stays in high level corresponds to a period of energized time $\tau 1$ of the driving voltage V1 (see FIG. 7B).

The driving voltage V2 is a voltage output from the tap TP2 of the voltage divider resistance circuit 23. The driving voltage V2 is output from the selector 24 as the voltage of Vcom by outputting the tap selection signal SS2 of high level to the switch circuit SW2 and switching the switch circuit SW2 on. A period of time when the tap selection signal SS2 stays in high level corresponds to a period of energized time $\tau 2$ of the driving voltage V2 (see FIG. 7B).

The driving voltage V3 is a voltage output from the tap TP3 of the voltage divider resistance circuit 23. The driving voltage V3 is output from the selector 24 as the voltage of Vcom by outputting the tap selection signal SS3 of high level to the switch circuit SW3 and switching the switch circuit SW3 on. A period of time when the tap selection signal SS3 stays in high level corresponds to a period of energized time $\tau 3$ of the driving voltage V3 (see FIG. 7B).

The driving voltage V4 is a voltage output from the tap TP4 of the voltage divider resistance circuit 23. The driving voltage V4 is output from the selector 24 as the voltage of Vcom by outputting the tap selection signal SS4 of high level to the switch circuit SW4 and switching the switch circuit SW4 on. A period of time when the tap selection signal SS4 stays in high level corresponds to a period of energized time τ4 of the driving voltage V4 (see FIG. 7B).

The driving voltage V4 is a voltage output from the tap TP5 of the voltage divider resistance circuit 23. The driving voltage V5 is output from the selector 24 as the voltage of Vcom by outputting the tap selection signal SS5 of high level to the switch circuit SW5 and switching the switch circuit SW5 on. A period of time when the tap selection signal SS5 stays in high level corresponds to a period of energized time τ5 of the driving voltage V5 (see FIG. 7B).

Thus, when selecting the output values, successively, based on the tap selection signals SS1 through SS5 output from the boost controller 22 from a lower rank of the output candidates of the driving voltages in the voltage divider resistance circuit 23 to a higher rank thereof, it is possible to supply the stepwise voltages of Vcom to the display portion 12.

Figure 4:
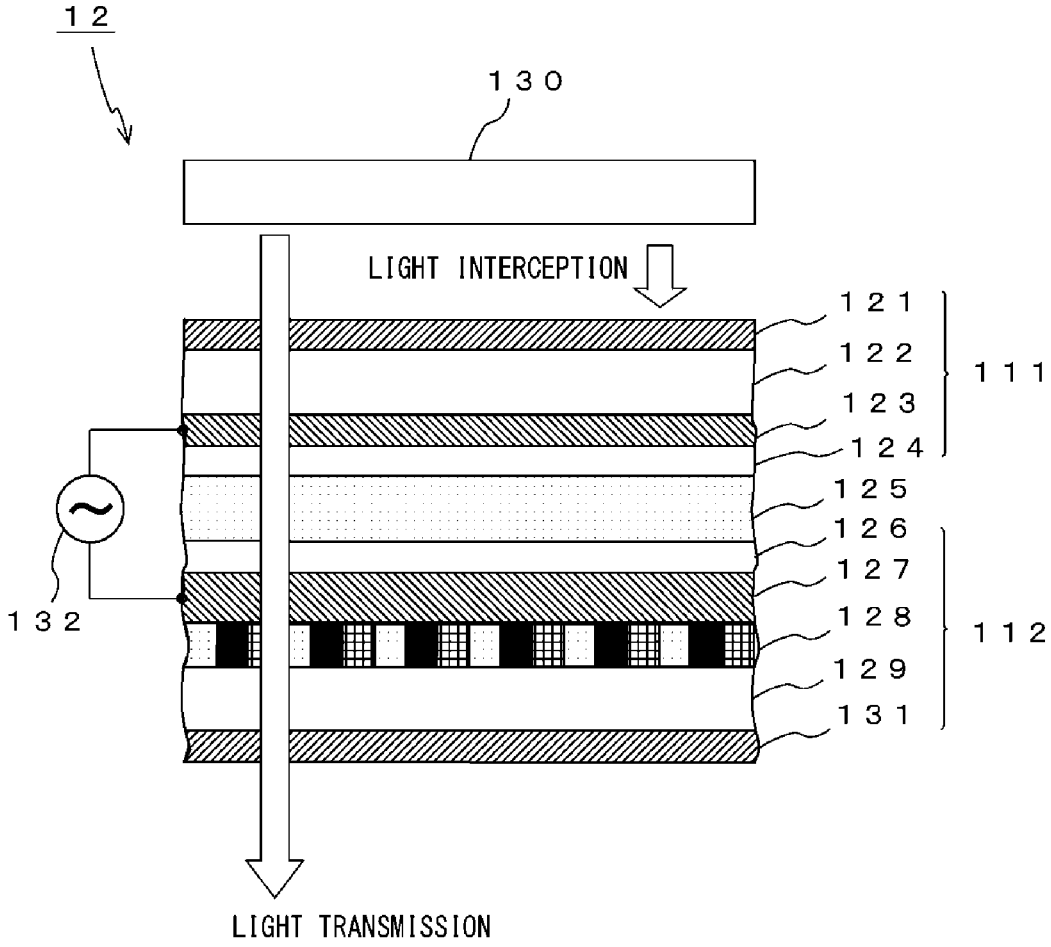
FIG. 4 is a section diagram of a display portion 12 showing a configuration example thereof.

Next, the following will describe a configuration example of the display portion 12 with reference to FIG. 4. The display portion 12 shown in FIG. 4 has the liquid crystal display substrate 101 in which a liquid crystal layer 125 is held by a substrate 111 of pixel electrode side and a substrate 112 of counter electrode side and is configured to be a liquid crystal shutter mechanism.

The substrate 111 of pixel electrode side contains a polarizing film 121, a glass substrate 122, a transparent conductive film 123 and a photo-alignment film 124 and is configured so that they are laminated successively. The transparent conductive film 123 constitutes a pixel electrode, a driving transistor or the like. The pixel electrode (Y direction electrode), the driving transistor and the like are provided for every pixel. The transparent conductive film 123 is led from the display portion 12 as the SEG wiring 14.

The substrate 112 of counter electrode side contains a photo-alignment film 126, a transparent conductive film 127, a color filter 128, a glass substrate 129 and a polarizing film 131 and is configured so that they are laminated successively. The transparent conductive film 127 constitutes a counter electrode (X direction electrode) at a position which faces the above-mentioned pixel electrode. The transparent conductive film 127 is provided for every line and the transparent conductive film 127 is led as the COM wiring 13.

The liquid crystal layer 125 is configured to have a shape such that the liquid crystal is held by the photo-alignment film 124 of the substrate 111 of pixel electrode side and the photo-alignment film 126 of the substrate 112 of counter electrode side. A signal source 132 (wiring voltage) based on the display information is applied across the transparent conductive film 123 constituting the pixel electrode and the transparent conductive film 127 constituting the counter electrode and the display driving is performed for every pixel. Thus, the liquid crystal display substrate 101 having the liquid crystal shutter mechanism is configured. Although, in this embodiment, in order to perform a color display, the color filter 128 has been inserted between the transparent conductive film 127 and the glass substrate 129, the color filter 128 may be omitted when performing a monochrome display.

Embodiment 1

Figure 5:
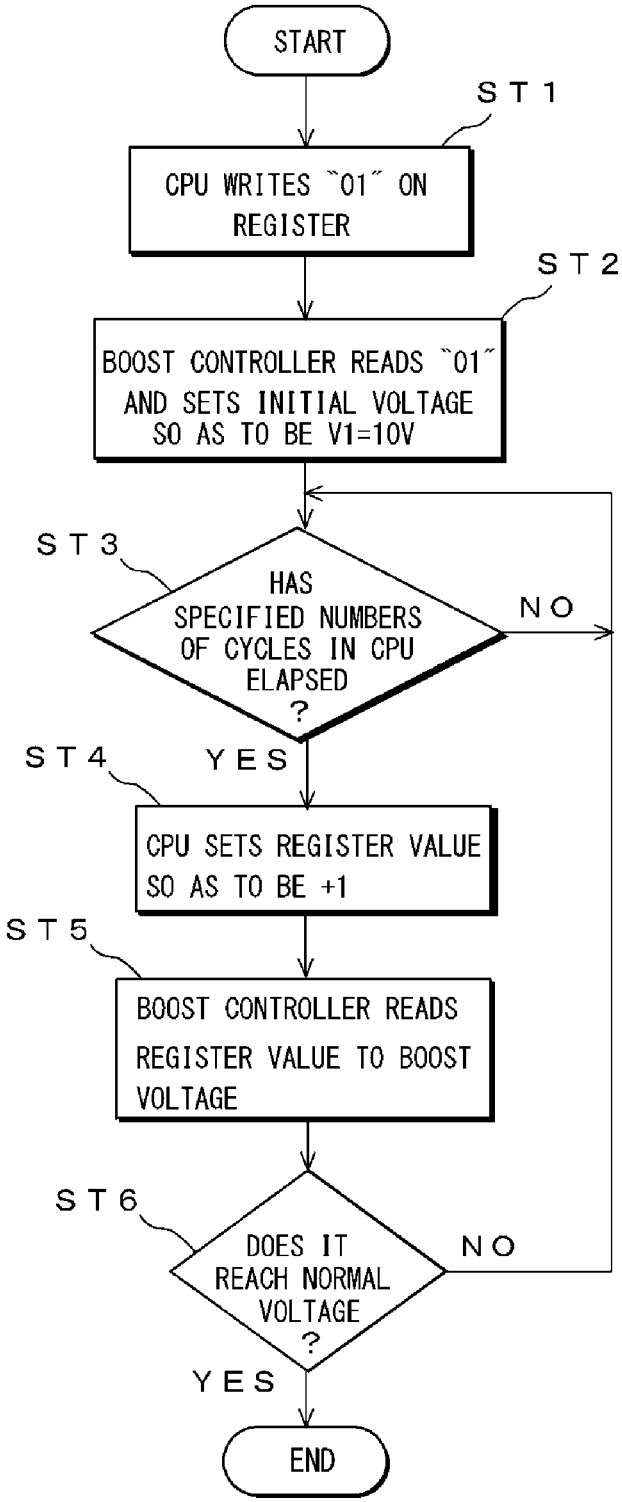
FIG. 5 is a flowchart showing a supplying example of voltage of Vcom by a driver IC 20 according to the first embodiment.

Next, the following will describe a supply example of the voltage of Vcom by the driver IC 20 according to the first embodiment with reference to FIG. 5. In this embodiment, it is assumed that the CPU 50 of the information displaying device 100 controls the driving of the display portion 12 that displays an image based on the display information and the predetermined driving voltages. The CPU 50 first sets (stores) a boost parameter on the register 21 when starting the display portion 12. The boost parameter includes a boost target value. As the boost target value, a case where an initial voltage value is set as to be, for example, the driving voltage V1=10V is illustrated. The maximum voltage value is set as to be the driving voltage V5 and the stepwise Vcom (driving voltages) is supplied to the COM electrode.

As they are supply conditions of the voltage of Vcom, at a step 1 of a flowchart shown in FIG. 5, in the sow starter 25*a*, the CPU 50 writes the boost parameter on the register 21 in order to set the boost target value of the driving voltage of the display portion 12. On the other hand, the voltage divider resistance circuit 23 divides the power supply voltage to generate the output candidates of the driving voltages having five output values (see FIG. 2).

At a step ST2, the boost controller 22 reads a value of "01" and sets the initial voltage value so as to be the driving voltage V1=10V. In this moment, the boost controller 22 fixes a boost step and a boost proposition based on the boost parameter of the register 21. In this moment, the selector 24 selects the tap TP1 based on the tap selection signal SS1. By the selection of the tap TP1, the first output candidate of the driving voltage is supplied to the display portion 12 as the voltage of Vcom.

Then, at a step ST3, the CPU 50 branches off the control thereof corresponding to whether or not a fixed period of specified time (specified numbers of cycles) has elapsed. The fixed period of specified time is given by a period of energized time of the tap selection signal SS1, in other words, a period of selection time for selecting the corresponding tap TP1 or the like (namely, a period of ON time of the switch circuit SW1). The period of selection time of the tap TP1 becomes the period of energized time of the driving voltage of the first output candidate. Further, if the fixed period of specified time (specified numbers of cycles) has not yet elapsed, the process goes back to the step ST3 where the selection of output of the driving voltage of the first output candidate based on the tap selection signal SS1 is continued.

If the fixed period of specified time (specified numbers of cycles) has elapsed, the process goes to a step ST4 where the CPU 50 sets the set value of the register 21 so as to be "+1". Then, at a step ST5, the boost controller 22 boosts the driving voltage based on the new register value. In this moment, the selector 24 selects the output value of the driving voltage of the second output candidate based on the tap selection signal SS2 and outputs the corresponding driving voltage as the voltage of Vcom.

Then, at a step ST6, the boost controller 22 compares the output value of the boosted voltage of Vcom with the previously set boost target value and determines whether or not the output value of the voltage of Vcom reaches the boost target value. If the voltage of Vcom does not reach the target (normal) voltage, the process goes back to the step ST3 where a fixed period of waiting time is again repeated.

If the fixed period of specified time (specified numbers of cycles) has elapsed, the process goes to the step ST4 where the CPU 50 sets the set value of the register 21 so as to be "+1". Then, at the step ST5, the boost controller 22 boosts the driving voltage based on the new register value. In this moment, the selector 24 selects the output value of the driving voltage of the second output candidate based on the tap selection signal SS3 and outputs the corresponding driving voltage as the voltage of Vcom.

Then, at the step ST6, the boost controller 22 compares the output value of the boosted voltage of Vcom with the previously set boost target value and determines whether or not the output value of the voltage of Vcom reaches the boost target value. If the voltage of Vcom reaches the target (normal) voltage, the supply control of the corresponding voltage of Vcom stops.

Thus, it is possible to boost the voltage of Vcom (driving voltage) in stages. The display portion 12 can be driven at the voltage of Vcom which is thus boosted in stages and is reached to the boost target value. In addition, since flowcharts for supplying the SEG-H voltage and the SEG-L voltage as other driving voltage for driving the display portion 12 are the same as the flowchart for supplying the voltage of Vcom, their descriptions will be omitted.

Thus, according to the information displaying device 100 of the first embodiment, the slow starter 25 including the slow starter 25*a* for COM voltage, the slow starter 25*b* for SEG-H voltage and the slow starter 25*c* for SEG-L voltage is provided in the driver IC 20.

The slow starters 25*a* through 25*c* include the boost controllers 22 which are connected with the registers 21 that respectively set the boost target values of the driving voltages of the display portion 12. Each respective boost controller 22 compares the output value of the driving voltage boosted by each of the selectors 24 with the boost target value set by the CPU 50, determines whether or not the output value of the driving voltage reaches the boost target value, and drives the display portion 12 at the driving voltage reaching the boost target value based on the determination result thereof.

Such display driving enables the driving voltage(s) for driving the display portion 12 to be booted by software. Furthermore, the slow starters 25*a* through 25*c* can be configured using generic circuit elements such as the voltage divider resistance circuit 23, the selector 24 and the like without adding any special devices. This allows the display portion 12 to start independent of any booster circuit of hardware configuration like the conventional system.

Further, each voltage divider resistance circuit 23 of the slow starters 25*a* through 25*c* can be formed as the semiconductor integrated circuit using the voltage divider resistance elements by a field effect transistor, the operational amplifier by a differential transistor or the like. Additionally, the selector 24 can be also formed as semiconductor integrated circuit using the selector by the same transistors.

Since it is possible to boost the driving voltage by selecting the same as desired in environment, not the fixed driving voltage by the booster circuit or the like as the conventional system, any stable operations can be expected without rendering a power supply futile. This enables the circuit scale thereof as a whole to be made smaller than that of the conventional system, which considerably contributes to downsizing and thinning of the information displaying device that is applicable to the electronic shelf label, the electronic personal authentication card, the electronic ticket and the like.

Additionally, when the power supply is turned off and any charges are removed from the display portion 12, the tap selection signals SS5 through SS1 may be output to the switch circuits SW5 through SW1 to select the taps TP5 through TP1 of the voltage divider resistance circuit 23 from the higher rank thereof to the lower rank thereof after the voltage divider resistance circuit 23 has been controlled to be separated from the power supply 4, and the switch circuits SW5 through SW1 may be turned on successively based on the tap selection signals SS5 through SS1 so that the resistance value in series is decreased so as to be decreased from the resistance element R5 to the resistance element R1 to remove the charges therefrom. In this moment, the charges may be removed through only the resistance element R1 by outputting the tap selection signal SS1 to only the switch circuit SW1 to turn the switch circuit SW1 on.

Further, when removing the charges at one action, it is controlled so that a new switch circuit SW0, not shown, is provided between the COM wiring 13 and a power supply line of lower power supply side, a tap selection signal SS0 when the power supply is turned off is created, and the voltage divider resistance circuit 23 is separated from the power supply 4; then, the charges may be removed through no resistance element by turning the switch circuit SW0 on based on the tap selection signal SS0.

Embodiment 2

Figure 6:
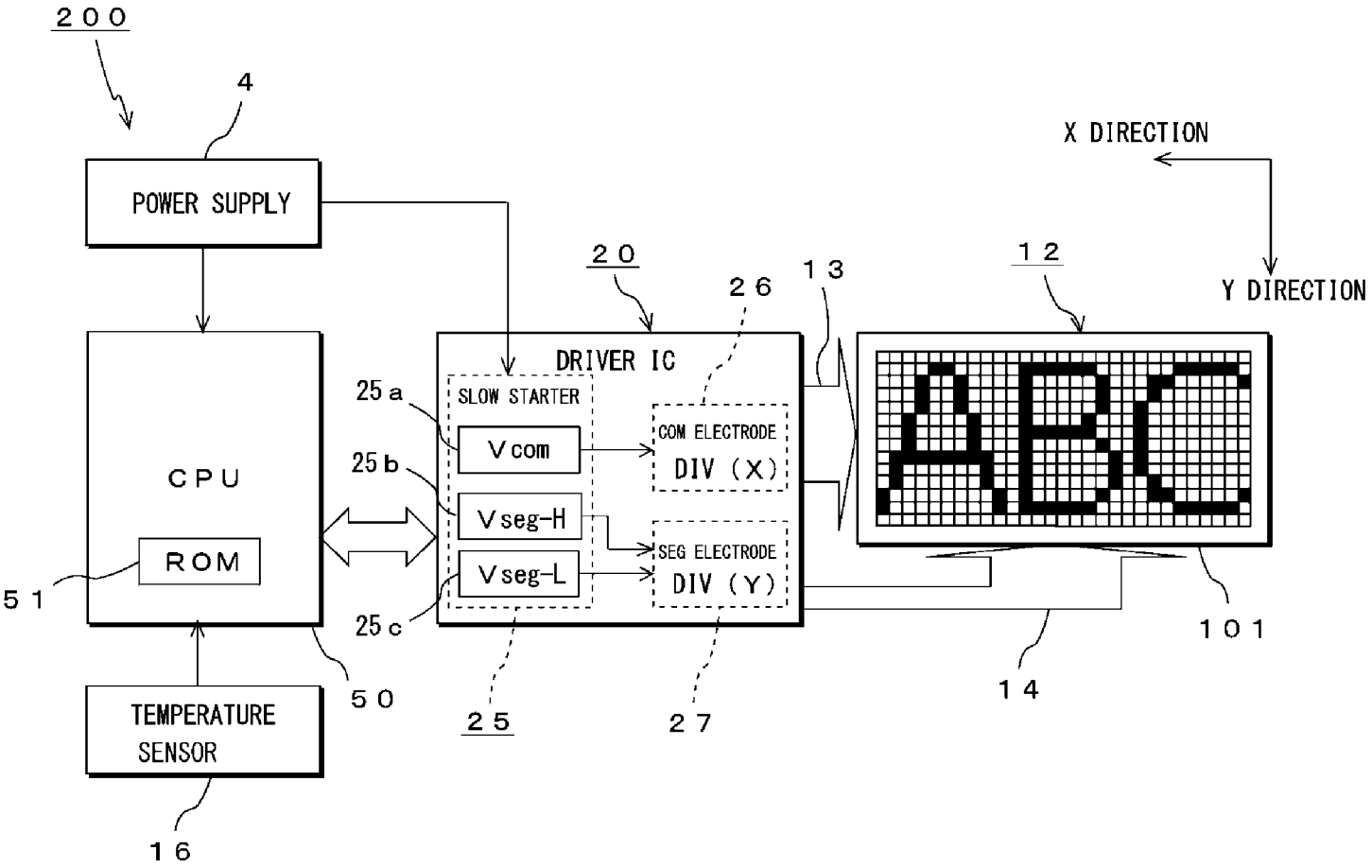
FIG. 6 is a block diagram of an information displaying device 200 as a second embodiment according to the invention showing a configuration example thereof.

The following will describe a configuration example of an information displaying device 200 according to the second embodiment with reference to FIG. 6. Liquid crystal is a device, the driving of which is basically unstable under a variation in temperature. If a fixed driving voltage is applied across the COM electrode and the SEG electrode while the temperature of the display portion 12 is low, no or dim display is performed. Accordingly, by this invention, it is possible to shorten a unit renewal time by setting the driving voltage as to be higher under a low temperature environment.

According to the information displaying device 200 shown in FIG. 6, a temperature sensor 16 constituting a temperature detecting portion is connected with the CPU 50. The temperature sensor 16 detects ambient temperature including the display portion 12 and outputs temperature information to the CPU 50. In this embodiment, ROM 51 constituting a storage portion is provided in the CPU 50. The ROM 51 stores the control target values of the driving voltage, which include boosted voltage one and dropped voltage one, corresponding to the temperature information obtained from the temperature sensor 16.

The CPU 50 operates to set the control target value referring to the ROM 51. For example, the CPU 50 sets (stores) on the register 21 a boost parameter which is fitted to a measured temperature by the temperature sensor 16. The boost controller 22 fixes to boost or drop the driving voltage based on the boost parameter of the register 21. Boost steps are basically the same as those of the flowchart shown in FIG. 5 except for a part thereof. Its explanation will be performed in FIG. 9. The drop steps are reverse operations of the boost steps.

Figure 9:
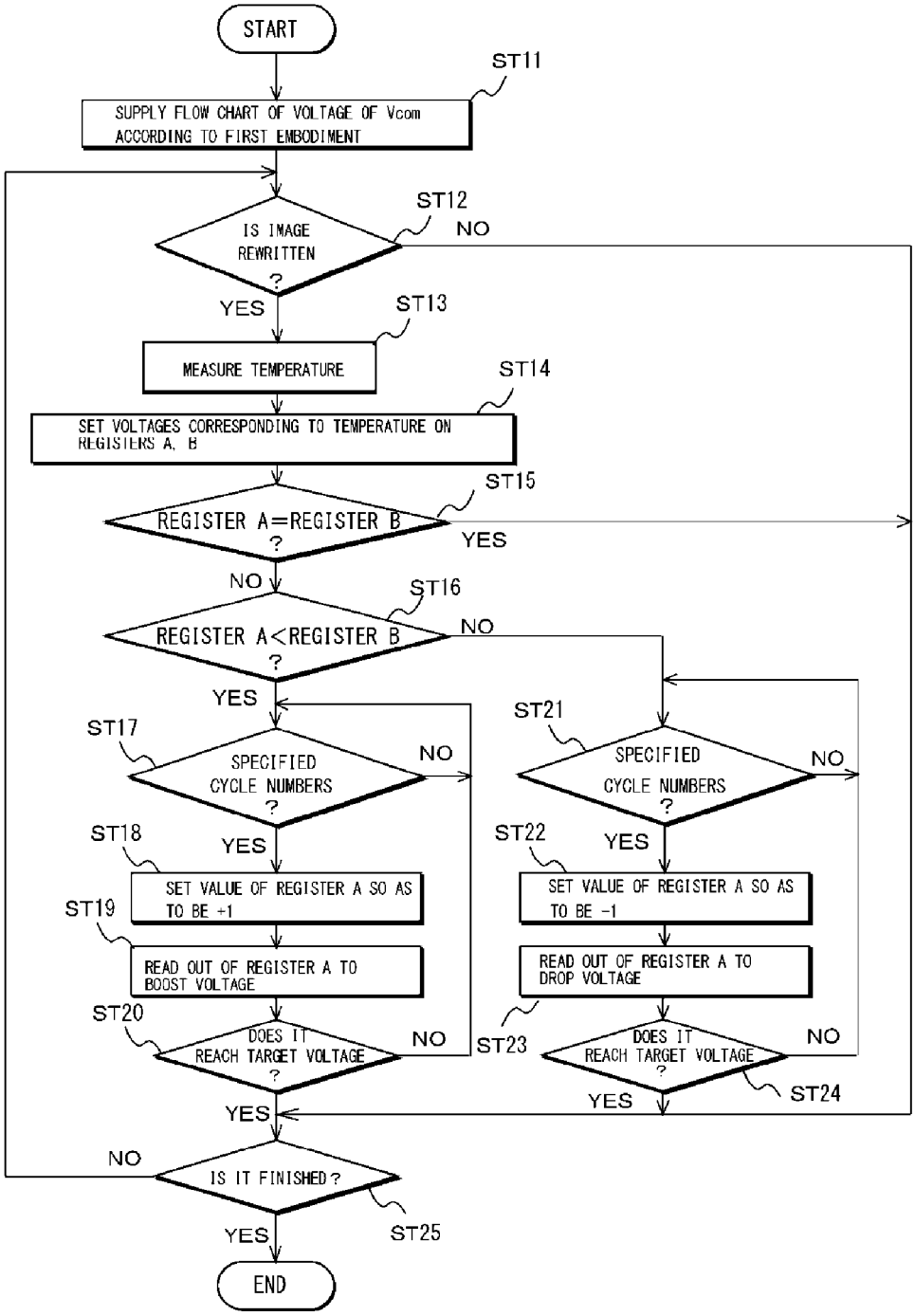
FIG. 9 is a flowchart showing a supplying example of voltage of Vcom by a driver IC 20 according to the second embodiment.

In the information displaying device 200, a step of detecting the ambient temperature including the display portion 12 and obtaining the temperature information may be carried out in a step ST11 of the flowchart shown in FIG. 9. Further, a step of reading and setting the control target value of the driving voltage corresponding to the temperature information obtained from the temperature sensor 16 may be carried out in a step ST14 of the flowchart shown in FIG. 9. It is to be noted that like signs and names described in the first embodiment have like function, a description of which will be omitted.

Figure 7A:
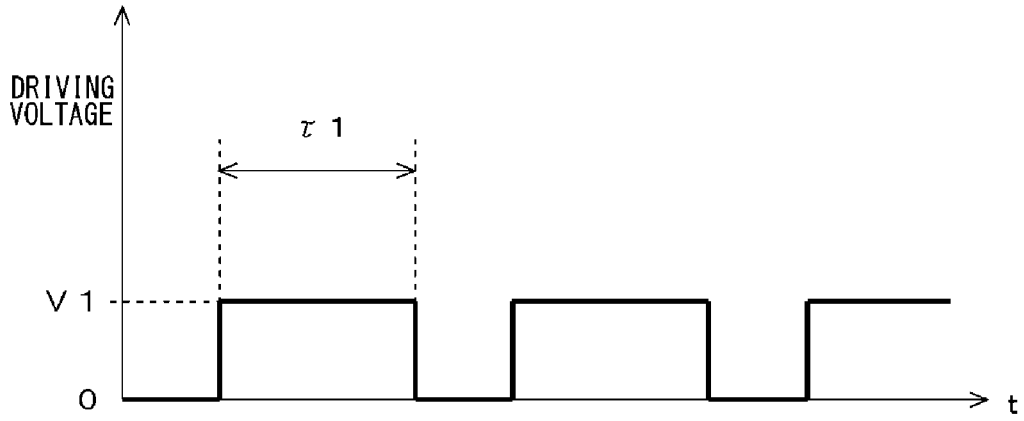
FIG. 7A is a wave form chart showing a voltage applying example (Part one) in the information displaying device 200.
Figure 7B:
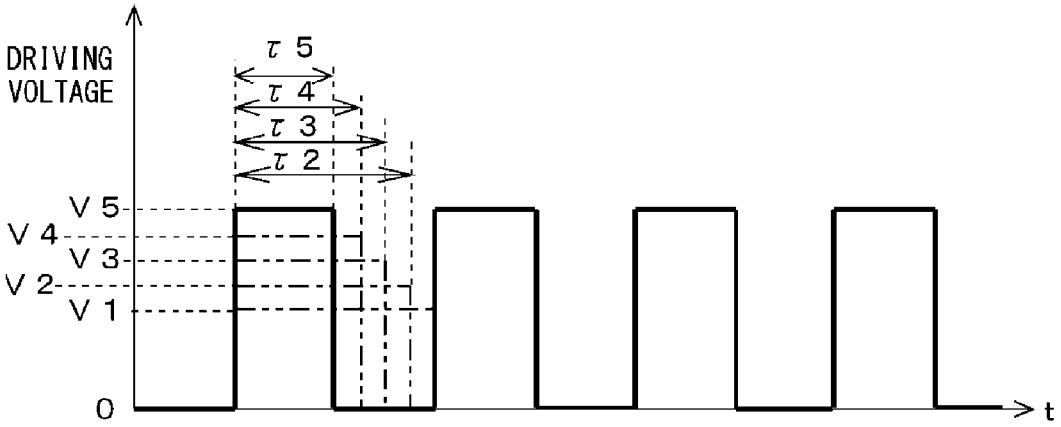
FIG. 7B is a wave form chart showing a voltage applying example (Part two) in the information displaying device 200.

Here, the following will describe an example of applying the voltage on the information displaying device 200 with reference to FIGS. 7A and 7B. In this example, it is set so that an amplifier and a period of energized time of the driving voltage are controlled on the basis of the temperature detection signal obtained from the temperature sensor 16.

In FIGS. 7A and 7B, vertical axes indicate the driving voltages corresponding to the voltage of Vcom, the SEG-H voltage and the SEG-L voltage. Traverse axes indicate time t. In FIG. 7A, $\tau 1$ indicates a period of energized time while the driving voltage V1 is energized. Hereinafter, the driving voltage during the period of energized time $\tau 1$ will be written as V1 ($\tau 1$). Waveforms of the driving voltages V2 through V5 shown by two-dot chain lines in FIG. 7B are depicted so that they are put one on another on the same time axis for convenience. The waveforms of the driving voltages V2 through V5 are generated on a case where driving energy applied across the COM electrode and the SEG electrode at the driving voltage V1 is fixed.

In FIG. 7B, τ2 indicates the period of energized time of the driving voltage V2 . Similarly, the driving voltage during the period of energized time τ2 will be written as V2 (τ2). τ3 indicates the period of energized time of the driving voltage V3. Similarly, the driving voltage during the period of energized time τ3 will be written as V3 (τ3). time τ4 indicates the period of energized time of the driving voltage V4. Similarly, the driving voltage during the period of energized time τ4 will be written as V4 (τ4). τ5 indicates the period of energized time of the driving voltage V5. Similarly, the driving voltage during the period of energized time τ5 will be written as V5 (τ5).

A magnitude correlation of five driving voltages V1 through V5 is set so as to be V5 (τ5)>V4 (τ4)>V3 (τ3)>V2 (τ2)>V1 (τ1). A magnitude correlation of the periods of energized time τ1 through τ5 of five driving voltages V1 (τ1) through V5 (τ5) is set so as to be τ1>τ2>τ3>τ4>τ5.

According to the example of applying the voltage on the information displaying device 200, when comparing the example of applying the voltage of conventional system with that of this invention, the driving voltage has been increased up to V1 (τ1) in the conventional system regardless of any variation in the ambient temperature including the display portion 12 and has continued to be applied as the voltage of Vcom or the like during the period of energized time τ1.

In this invention, any variation in the ambient temperature including the display portion 12 is detected and the driving voltage is increased up to V2 (τ2), V3 (τ3), V4 (τ4) or V5 (τ5), amplitudes of which are higher than that of the driving voltage V1 (τ1), corresponding to the detected temperature information and continues to be applied as the voltage of Vcom or the like during the periods of energized time τ2, τ3, τ4 or τ5 each of which is shorter than the period of energized time τ1 of the driving voltages V1 (τ1).

Thus, when deciding the conditions of the ambient temperature including the display portion 12 that the temperature thereof is lower than that of the normal operation time, the voltage of Vcom having a higher amplitude is applied during a shorter period of energized time so that it is possible to avoid displaying no display information on the display portion 12 like the conventional system.

Figure 8:
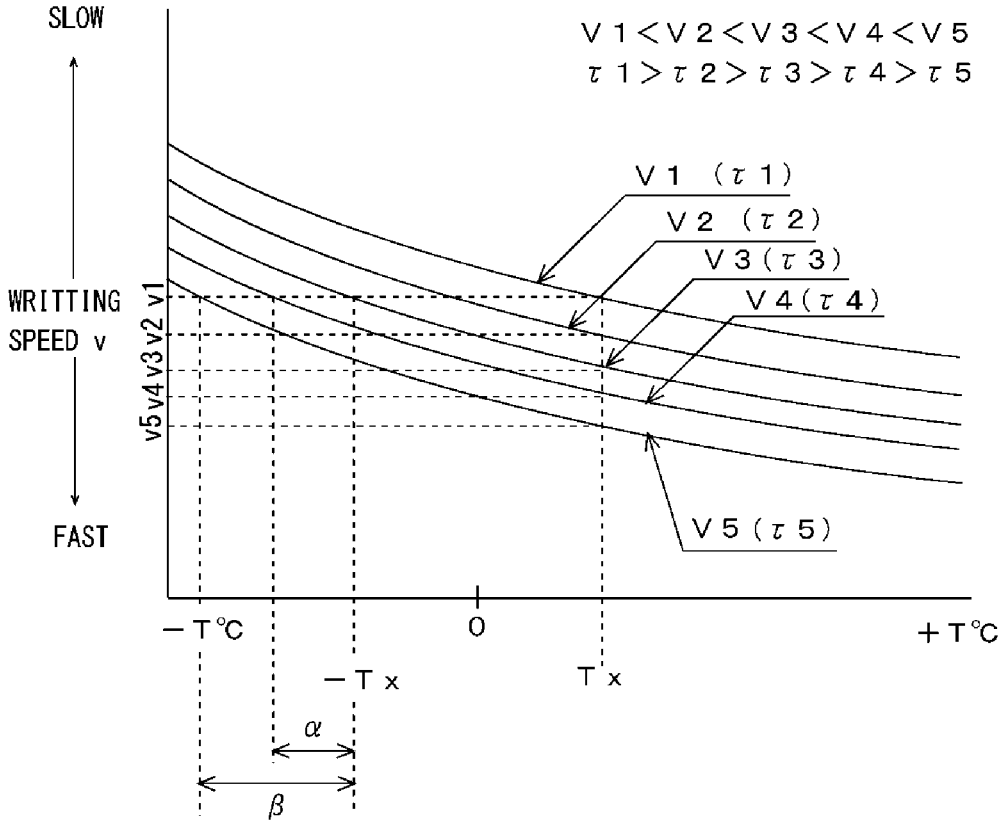
FIG. 8 is a graph showing a storage example of boost target values in ROM.

Next, the following will describe a storage example of the control target values in the ROM 51. In FIG. 8, a vertical axis indicates a writing speed v (ms/line) and plots the writing speed of the display information per one line of the display portion 12. The writing speed v is dependent on the driving voltages such as the voltage of Vcom, the SEG-H voltage, the SEG-L voltage and the like. The higher the writing speed is on the vertical axis, "the writing speed becomes slower"; and the lower the writing speed is thereon, "the writing speed becomes faster".

A traverse axis indicates ambient temperature (° C.). The traverse axis includes 0° C., a left side of the traverse axis plots −T° C. and a right side of the traverse axis plots +T° C. Five declining driving voltage curves in value downward to the right are obtained by measuring the writing speed v of the display information per one line of the corresponding display portion 12 against the ambient temperature including the display portion 12 using the five driving voltages V1 (τ1) through V5 (τ5) as the parameters thereof.

In the storage example of the control target values in the ROM 51, when the magnitude correlation of the writing speed v is set so as to be V1>V2>V3>V4>V5 and, for example, the driving voltage V1 (τ1) is set at the ambient temperature Tx° C. including the display portion 12, the writing speed v1 is attained. When making the further writing speed faster from this setting condition at the ambient temperature Tx° C. including the display portion 12, it is configured so that as the control target values in boost time, the driving voltages V2 (τ2), V3 (τ3), V4 (τ4), V5 (τ5) and the like are set from the driving voltage V1 (τ1).

When the setting is changed from the driving voltage V1 (τ1) to the driving voltage V2 (τ2), the writing speed v is improved from v1 to v2. When the setting is changed from the driving voltage V2 (τ2) to the driving voltage V3 (τ3), the writing speed v is improved from v2 to v3. When the setting is changed from the driving voltage V3 (τ3) to the driving voltage V4 (τ4), the writing speed v is improved from v3 to v4. When the setting is changed from the driving voltage V4 (τ4) to the driving voltage V5 (τ5), the writing speed v is improved from v4 to v5.

Further, when the information displaying device 200 is used in a cold district, a freezer or the like from the ambient temperature Tx° C. including the display portion 12 under the above-mentioned setting condition and the writing speed is set so as to be the writing speed v1 or faster, it is configured so that as the control target values in boost time, the driving voltages V3 (τ3), V4 (τ4), V5 (τ5) and the like are set from the driving voltage V1 (τ1). In this embodiment, when the driving voltage V3 (τ3) is applied at the ambient temperature −Tx° C. including the display portion 12, the writing speed v1 is attained.

Further, it is possible to acquire ambient temperature, from the driving voltage curves, when the driving voltages V4(τ4), V5(τ5) which obtain the writing speed v1 that is similar to the writing speed v1 obtained at the ambient temperature Tx° C. including the display portion 12 under the above-mentioned setting condition, are applied to the display portion 12. In this embodiment, the ambient temperature when the driving voltage V4(τ4) is applied to the display portion 12 is −(T+α)° C. The ambient temperature when the driving voltage V5(τ5) is applied to the display portion 12 is −(T+β)° C.

The α is a difference between the ambient temperature obtaining the writing speed v1 at the driving voltage V3 (τ3) and the ambient temperature obtaining the writing speed v1 at the driving voltage V4(τ4). The β is a difference between the ambient temperature obtaining the writing speed v1 at the driving voltage V3 (τ3) and the ambient temperature obtaining the writing speed v1 at the driving voltage V5 (τ5).

The ROM 51 stores a relationship between the ambient temperature (° C.) including the above-mentioned display portion 12 and any driving voltages V1 (τ1) through V5 (τ5) constituting the five driving voltage curves. For example, it is configured so that the ambient temperature (° C.) including the display portion 12 is addressed and any driving voltages V1 (τ1) through V5(τ5) are read out to set the control target value when boosting the voltage.

The following will describe a supplying example of voltage of Vcom by a driver IC 20 according to the second embodiment. In this example, a case will be described where after the voltage supply flowchart according to the first embodiment has been performed, a request for rewriting an image is performed, the ambient temperature including the display portion 12 is detected and the driving voltage is boosted (temperature-dropping time) or dropped (temperature-raising time) based on the detected temperature information. It is estimated that the temperature-dropping time is when the information displaying device 200 moves from a constant temperature environment to the freezer or the like and the temperature-raising time is when the information displaying device 200 moves from the freezing environment to the constant temperature environment.

<Temperature-dropping Time>

Under their supplying conditions of driving voltages, following the supply flowchart of the voltage of Vcom according to the first embodiment at a step ST11 shown in FIG. 9, at a step ST12, the CPU 50 branches off the control thereof corresponding to the request for rewriting the image. When changing the usage environment of the information displaying device 200 to rewrite the image, the process goes to a step ST13 where the CPU 50 controls the temperature sensor 16 to measure the temperature.

The temperature sensor 16 detects ambient temperature including the display portion 12 and outputs the detected temperature information to the CPU 50. At a step ST14, the CPU 50 sets the driving voltage corresponding to the ambient temperature including the display portion 12 on the register B, not shown. It sets the driving voltage which becomes the control target value corresponding to the ambient temperature on the register A (corresponding to the register 21). Regarding the register 21, see the step ST2 of the first embodiment.

Then, at a step ST15, the CPU 50 compares the value of the register B with the value of the register A to perform a match retrieval (register A=register B) and branches off the control thereof. When the value of the register A is different from (does not match) the value of the register B, at a step ST16, the CPU 50 branches off the control thereof based on a case (YES: temperature-dropping time) where the relationship between the value of the register A and the value of the register B is so as to be the register A<the register B and a case (NO: temperature-raising time) where it is so as to be the register A>the register B.

When it is the register A<the register B, namely, the information displaying device 200 moves from the constant temperature environment to the freezer or the like, at a step ST17, the CPU 50 branches off the control thereof based on whether or not it reaches the specified cycle numbers of CPU. When it does not reach the specified cycle numbers, the process goes back to the step ST17 where it waits until it reaches the specified cycle numbers. Regarding the specified cycle numbers, see the step ST3 of the first embodiment.

When it reaches the specified cycle numbers, the process goes to a step ST18 where the CPU 50 increments the value of the register A to +1. Regarding the value of the register A of +1, see the step ST4 of the first embodiment. Then, at a step ST19, the CPU 50 reads out of the register A to boost the voltage (boosting control). Regarding this boosting control, see the step ST5 of the first embodiment.

Then, at a step ST20, the control is branched off on the basis of whether or not it reaches a target voltage. Regarding whether or not it reaches the target voltage, see the step ST6 of the first embodiment. When it reaches the target voltage, the process goes to a step ST25. When it does not reach the target voltage, the process goes back to the step ST17 where the above-mentioned boosting control is repeated.

<Temperature-raising Time>

When the relationship between the value of the register A and the value of the register B is the register A>the register B (NO) at the step 16, namely, the information displaying device 200 moves from the freezer or the like to the constant temperature environment, at a step ST21, the CPU 50 branches off the control thereof based on whether or not it reaches the specified cycle numbers of CPU. When it does not reach the specified cycle numbers, the process goes back to the step ST21 where it waits until it reaches the specified cycle numbers. When it reaches the specified cycle numbers, the process goes to a step ST22 where the CPU 50 sets the value of the register A to be −1.

Then, at a step ST23, the CPU 50 reads out of the register A to drop the voltage (dropping control). In this moment, the boost controller 22 drops the driving voltage to the new register value. The selector 24 selects the output value of the driving voltage from the output candidates based on the tap selection signal SS2 and outputs the corresponding driving voltage as the voltage of Vcom.

At a step ST24, the control is then branches off on the basis of whether or not it reaches a target voltage. In this moment, the boost controller 22 compares an output value of the dropped voltage of Vcom with the previously set drop target value and determines whether or not the output value of the voltage of Vcom reaches the drop target value. When the output value of the voltage of Vcom does not reach the target (normal) voltage, the process goes back to the step ST21 where a fixed period of waiting time repeats.

When a period of specified time (cycle numbers) has elapsed, the process goes to the step ST22 where the CPU 50 sets the value of the register A to be −1. Then, at the step ST23, the boost controller 22 drops the driving voltage to the new register value. In this moment, the selector 24 selects the output value of the driving voltage from the output candidates based on the tap selection signal SS3 and outputs the corresponding driving voltage as the voltage of Vcom.

Then, at the step ST24, the boost controller 22 compares an output value of the dropped voltage of Vcom with the previously set drop target value and determines whether or not the output value of the voltage of Vcom reaches the drop target value. When the voltage of Vcom reaches the target (normal) voltage, the process goes to a step ST25. When it does not reach the target voltage, the process goes back to the step ST21 where the above-mentioned dropping control repeats.

It is to be noted that if the image is not rewritten at the above-mentioned step ST12; if it is detected that the value of the register A and the value of the register B are matched (register A=register B) at the step ST15; if it reaches the target voltage at the step ST20 and if it reaches the target voltage at the step ST24, the CPU 50 performs a finish determination at the step ST25.

A finish determination criterion in this moment, for example, the CPU 50 detects any power-off information. When the power-off information is detected, the supply control of the corresponding voltage of Vcom finishes. When the power-off information is not detected, the process goes to the step ST12 where the supply control of the voltage of Vcom repeats.

Thus, by the information displaying device 200 according to the second embodiment, it is possible to provide the temperature sensor 16 and the ROM 51, to select the driving voltages V1 (τ1) through V5 (τ5) corresponding to the ambient temperature including the display portion 12 by software, and to set it on the slow starters 25*a* through 25*c*. Such a configuration enables the voltage of Vcom (driving voltage) to be boosted or dropped in stages.

It is possible to drive the display portion 12 at the voltage of Vcom which is boosted or dropped in stages up to the boost target value or down to the drop target value. Therefore, it is possible to correspond to a variation in the ambient temperature including the display portion 12 soon and avoid displaying no display information and displaying dam display information. This enables an information processing system using an electronic shelf label, an electronic personal authentication card, an electronic ticket and the like, which have cold-area specifications.

Embodiment 3

Figure 10:
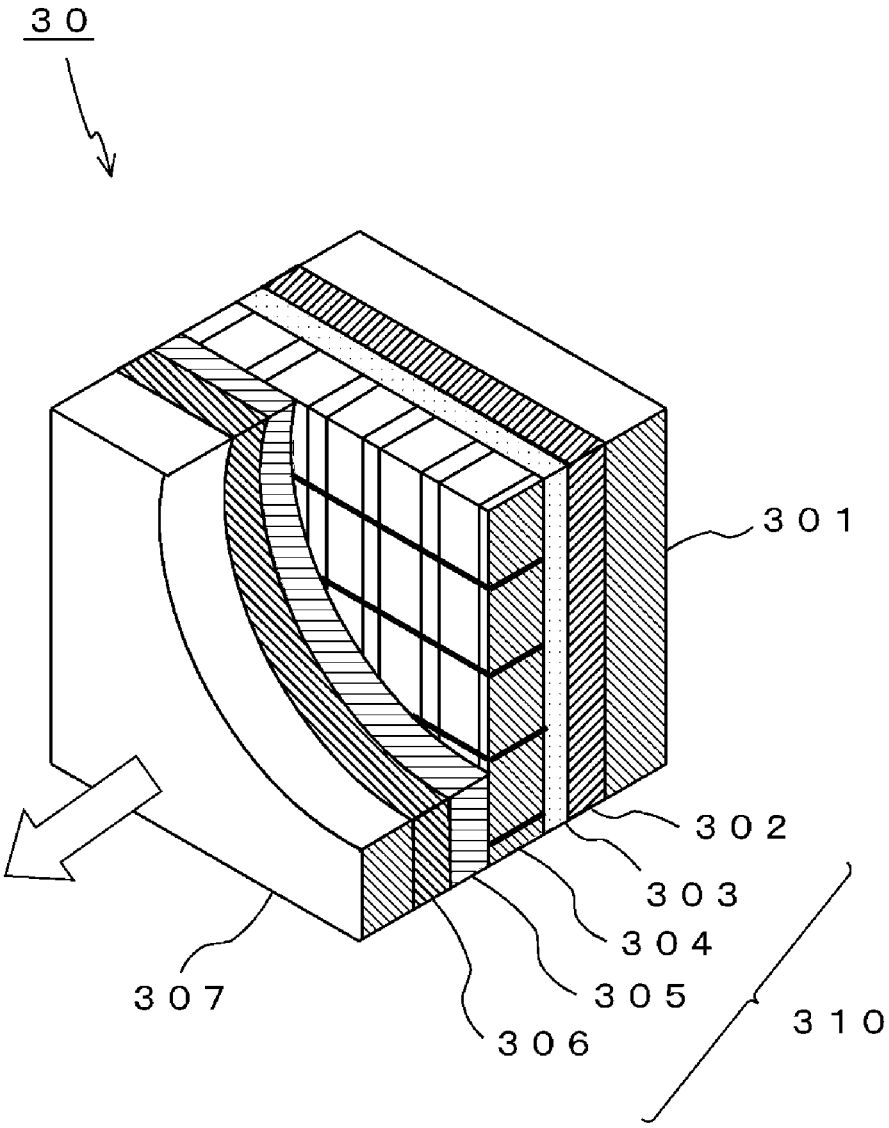
FIG. 10 is a perspective view of a display portion 30 according a third embodiment showing a configuration example thereof.

Next, the following will describe a configuration example of a display portion 30 according to a third embodiment with reference to FIG. 10. The display portion 30 shown in FIG. 10 is applicable display means in place of the display portions 12 of the information displaying devices 100, 200. The display portion 30 contains an organic EL display substrate that is available to the information displaying devices 100, 200.

The display portion 30 has a seal glass plate 301, a cover glass plate 307 and an organic EL thin film 310. The organic EL display substrate is configured so that the organic EL thin film 310 is held by the glass plate 301 and the glass plate 307. The organic EL thin film 310 is configured so that a negative electrode 302 having a transparent conductive film for a data line, an electron transporting layer 303 which transports an electron, a light emitting layer 304 which emits light, a hole transporting layer 305 which transports a hole and a positive electrode 306 having a transparent conductive film for a scanning line are laminated successively.

Thus, in the display portion 30 according to the third embodiment, which is available to the information displaying devices 100, 200, the light emitting layer 304 emits the light by applying alternating current pulse voltages across the transparent conductive film constituting the negative electrode 302 and the positive electrode 306 having the transparent conductive film for the scanning line based on the display information. This enables to be configured the organic EL display substrate that is available to the information displaying devices 100, 200. An inorganic EL display substrate other than the organic EL display substrate is available to the information displaying devices 100, 200.

Embodiment 4

Figure 11:
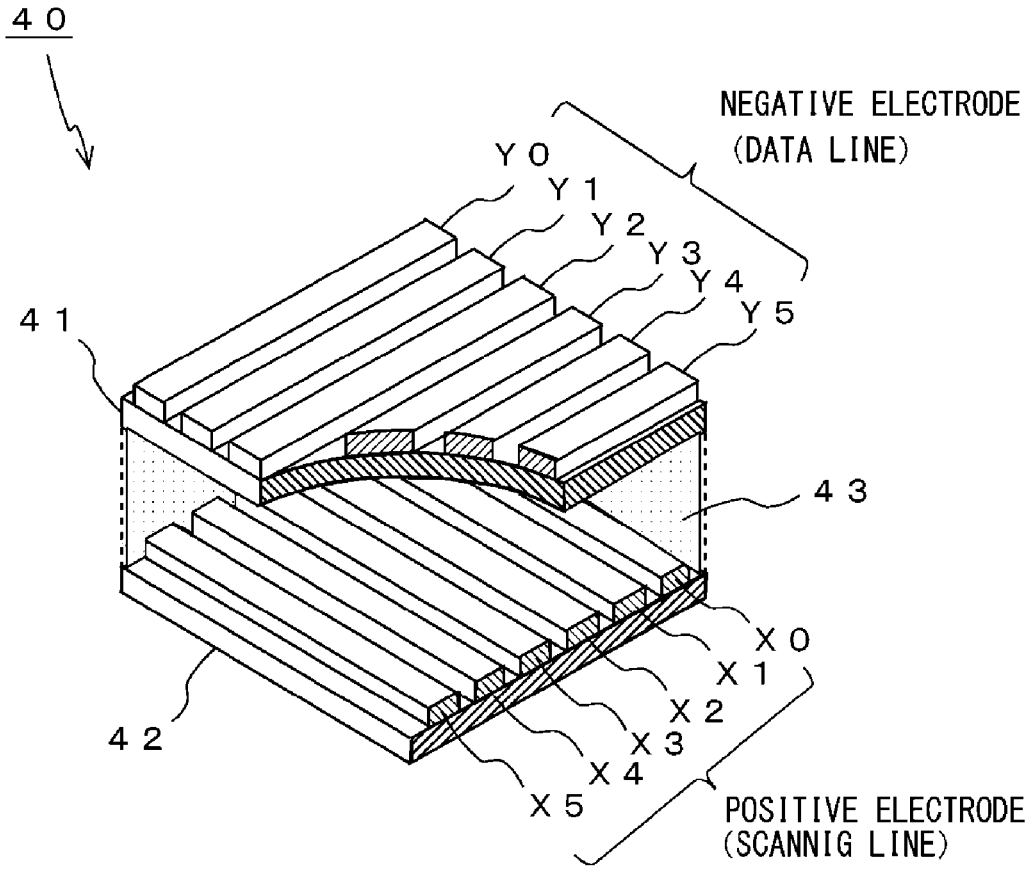
FIG. 11 is a perspective view of a display portion 40 according a fourth embodiment showing a configuration example thereof.
Figure 12:
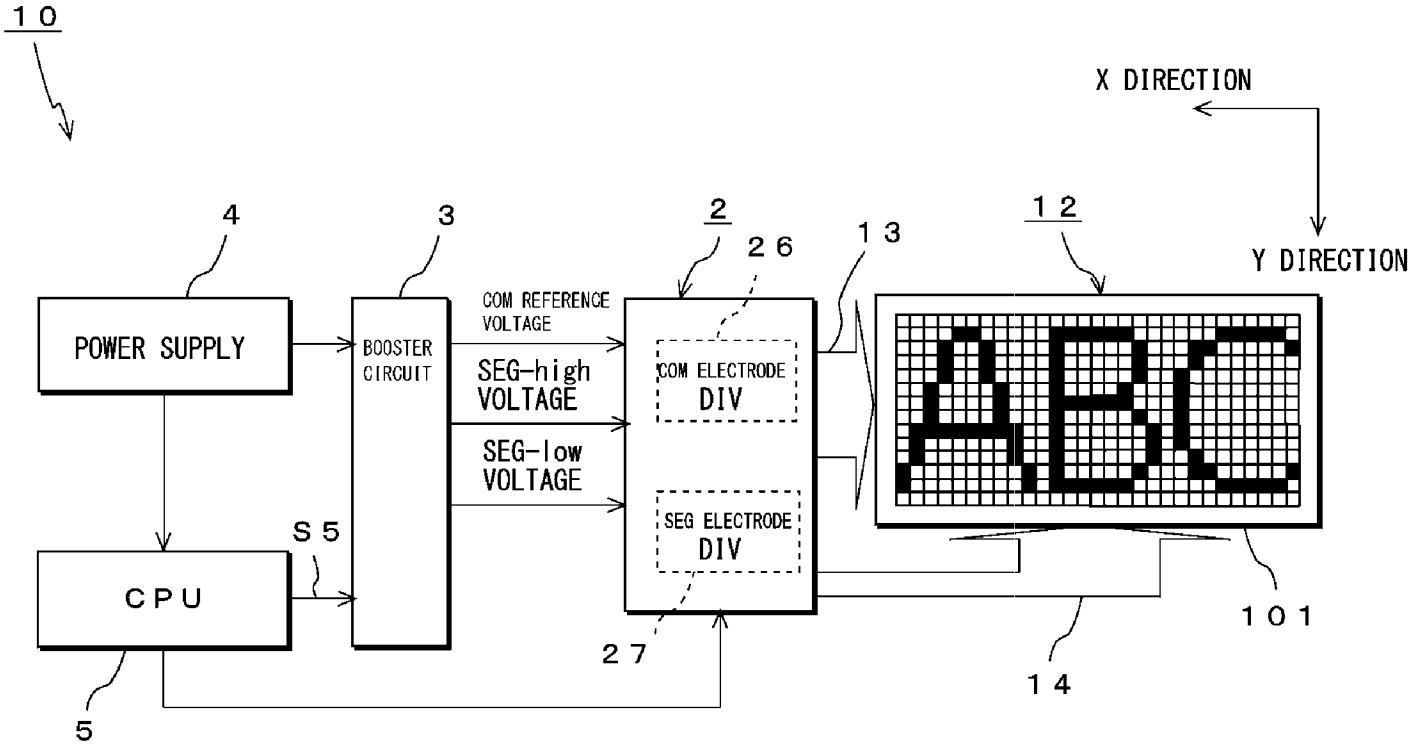
FIG. 12 is a block diagram of an information displaying device 10 according to a conventional example showing a configuration example thereof.

The following will describe a configuration example of a display portion 40 according to a fourth embodiment with reference to FIG. 11. The display portion 40 shown in FIG. 11 configures an applicable organic EL display substrate of passive matrix type in place of the display portions 12 of the information displaying devices 100, 200. The display portion 40 has a glass plate 41 of negative electrode side, a glass plate 42 of positive electrode side and an organic EL thin film 43 and the organic EL display substrate of passive matrix type is configured so that the organic EL thin film 43 is held by the glass plate 41 of the negative electrode side and the glass plate 42 of the positive electrode side.

Y electrodes constituting the negative electrode (data line), in this embodiment, six electrodes Y0 through Y5 are arranged on the glass plate 41 of the negative electrode side. The electrodes Y0 through Y5 are composed of conductive film. X electrodes constituting the positive electrode (scanning line), in this embodiment, six electrodes X0 through X5 are arranged on the glass plate 42 of the positive electrode side. The electrodes X0 through X5 are composed of transparent conductive film. The glass plate 41 of the negative electrode side and the glass plate 42 of the positive electrode side are assembled so that the electrodes X0 through X5 and the electrodes Y0 through Y5 are perpendicular to each other and the organic EL thin film 43 is held by them.

Thus, in the display portion 40 according to the fourth embodiment, which is available to the information displaying devices 100, 200, the organic EL thin film 43 emits the light by applying alternating current pulse voltages across the conductive film (the electrodes Y0 through Y5) constituting the negative electrode and the transparent conductive film (the electrodes X0 through X5) constituting the positive electrode based on the display information. This enables to be configured the organic EL display substrate of passive matrix type that is available to the information displaying devices 100, 200.

By using the information displaying devices 100, 200 according to the first through fourth embodiments, it is possible to create an information processing system such as an electronic shelf label system, an electronic personal authentication system, an electronic ticket system and the like.

This invention is very preferably applied to the electronic shelf label (price tag), the electronic personal authentication card, then electronic ticket and the information processing system applying the same, on which an image about a name of article, its price and the like is displayed using a light, thin and small sized display panel.

DESCRIPTION OF CODES

4 . . . Power Supply; 12, 30, 40 . . . Display Portion; 13 . . . COM wiring; 14 . . . SEG wiring; 16 . . . Temperature Sensor; 20 . . . Driver IC; 21 . . . Register; 22 . . . Boost Controller; 23 . . . Voltage Divider Resistance Circuit; 24 . . . Selector; 25 . . . Slow Starter; 25*a* . . . Slow Starter for Vcom; 25*b* . . . Slow starter for Vseg-H; 25*c* . . . Slow starter for Vseg-L; 26 . . . X Driver (COM Electrode DIV(X)); 27 . . . Y Driver (SEG Electrode DIV(Y)); 50 . . . CPU; 51 . . . ROM and 100, 200 . . . Information Displaying Device.

What is claimed is:

1. An information displaying device comprising:

a display portion that displays an image based on display information and a predetermined driving voltage;

an information-setting portion that is connected to a plurality of slow starters with each comprising a register, wherein the information-setting portion is configured to set a boost target value of the driving voltage of the display portion in each of the registers;

a voltage output portion that divides a power supply voltage to generate output candidates of the driving voltage having plural output values, each output value having a different voltage value and a different corresponding period of energized time;

a voltage selection portion that selects the output values, successively, based on a predetermined selection control signal from a lower rank of the output candidates of the driving voltage in the voltage output portion to a higher rank thereof and boosts the driving voltage; and a boost control portion, wherein for each successive selection performed by the voltage selection portion, the boost control portion is configured to:

(i) compare the output value of the driving voltage boosted by the voltage selection portion with the boost target value set by the information-setting portion, (ii) determine whether or not the output value of the driving voltage reaches the boost target value, and (iii) drive the display portion at the driving voltage reaching the boost target value based on the determination in step (ii).

2. The information displaying device according to claim 1 wherein the voltage output portion, the driving voltage of which is boosted by the voltage selection portion, comprises a voltage divider resistance circuit containing a series circuit in which plural resistance elements are connected in series, an end of the series circuit being connected with a higher potential side, the other end of the series circuit being connected with a lower potential side and taps being tapped from a connection point between the resistance elements.

3. The information displaying device according to claim 2 wherein the voltage selection portion comprises a selector which is connected with the plural taps of the voltage output portion and selects the tap based on a predetermined selection control signal.

4. The information displaying device according to claim 1 wherein the voltage output portion comprises an operational amplifier which generates the driving voltage based on a predetermined gain control signal.

5. The information displaying device according to claim 1 further comprising:

a temperature detecting portion that detects ambient temperature including the display portion and outputs temperature information to the information-setting portion; and a storage portion that stores the boost target value of the driving voltage corresponding to the temperature information obtained from the temperature detecting portion.

6. The information displaying device according to claim 1 further comprising:

a liquid crystal layer in which liquid crystal is held between photo-alignment films;

a substrate of pixel electrode side that includes a pixel electrode for every pixel and contains a polarizing film, a glass plate and a transparent conductive film for the pixel electrode, and from which a pixel wiring is led; and a substrate of counter electrode side that includes a counter electrode at a position which faces the pixel electrode and contains a polarizing film, a glass plate and a transparent conductive film for the counter electrode, and from which a counter wiring is led, wherein the display portion includes a liquid crystal display substrate in which the liquid crystal layer is held by the substrate of pixel electrode side and the substrate of counter electrode side.

7. The information displaying device according to claim 1 wherein the display portion comprises:

an organic EL thin film containing at least a positive electrode having a transparent conductive film for a scanning line, a hole transporting layer which transports a hole, a light emitting layer which emits light, an electron transporting layer which transports an electron, and a negative electrode having a transparent conductive film for a data line;

a cover glass substrate; and a seal glass substrate, wherein the display portion includes an organic EL display substrate in which the organic EL layer is held by the cover glass plate and the seal glass.

8. A display driving method of controlling the driving of a display portion that displays an image based on display information and a predetermined driving voltage, the method comprising:

setting, by an information-setting portion of an information displaying device, a plurality of boost target values of a driving voltage of the display portion, wherein each boost target value is set in a register of a slow starter of the information displaying device;

dividing, by a voltage output portion of the information displaying device, a power supply voltage to generate output candidates of the driving voltage having plural output values, each output value having a different voltage value and a different corresponding period of energized time;

selecting, by a voltage selection portion of the information displaying device, the output values, wherein the output values are selected successively based on a predetermined selection control signal from a lower rank of the output candidates of the driving voltage to a higher rank thereof and boosting the driving voltage;

wherein, for each successive selection performed by the voltage selection portion, a boost control portion is configured to:

(i) compare the output value of the boosted driving voltage with the set boost target value;

(ii) determine whether or not the output value of the driving voltage reaches the boost target value; and (iii) drive the display portion at the driving voltage reaching the boost target value based on the determination in step (ii).

9. The display driving method according to claim 8 further comprising:

detecting ambient temperature including the display portion and obtaining temperature information; and reading out the boost target value of the driving voltage corresponding to the obtained temperature information to set it.

10. An information displaying device comprising:

a display portion that displays an image based on display information and a predetermined driving voltage;

a voltage generating portion that generates driving voltage of the display portion based on a control target value thereof;

a temperature detecting portion that detects ambient temperature including the display portion and outputs temperature information;

an information-setting portion that sets the control target value of the driving voltage of the display portion in the voltage generating portion, the control target value corresponding to the temperature information output from the temperature detecting portion;

a display controlling portion that drives the display portion based on the driving voltage of the control target value set in the voltage generating portion by the information-setting portion; and a storage portion that stores the control target value of the driving voltage of the display portion, the control target value corresponding to the temperature information obtained from the temperature detecting portion, wherein the storage portion stores a look up table in which the control target value of the driving voltage of the display portion is set as a parameter, a writing speed of the driving voltage is plotted on a vertical axis, and the ambient temperature including the display portion is plotted on a transverse axis and by which the writing speed of the driving voltage corresponding to the temperature information is previously looked up.

11. The information displaying device according to claim 10, wherein the voltage generating portion comprises:

a voltage output portion that divides a power supply voltage to generate output candidates of the driving voltage having plural output values; and a voltage selection portion that selects the output candidates of the driving voltage generated by the voltage output portion, successively, having plural output values, based on a predetermined selection control signal.

12. A display driving method of controlling the driving of a display portion that displays an image based on display information and a predetermined driving voltage, the method comprising:

generating the driving voltage of the display portion based on a control target value thereof;

detecting ambient temperature including the display portion and obtaining temperature information;

setting the control target value of the driving voltage of the display portion, the control target value corresponding to the obtained temperature information; and driving the display portion based on the driving voltage of the set control target value;

wherein a look up table is stored in a storage portion, wherein the control target value of the driving voltage of the display portion is set in the storage portion as a parameter, and wherein a writing speed of the driving voltage is plotted on a vertical axis, and the ambient temperature including the display portion is plotted on a transverse axis by which a writing speed of the driving voltage corresponding to the temperature information is previously looked up.

* * * * *